US008594549B2

(12) United States Patent
Shimokawa et al.

(10) Patent No.: US 8,594,549 B2
(45) Date of Patent: Nov. 26, 2013

(54) IMAGE FORMING APPARATUS INCORPORATING A FIXING DEVICE AND CONTACT MEMBER TO REDUCE FIXING MEMBER DEFORMATION

(75) Inventors: Toshihiko Shimokawa, Zama (JP); Masaaki Yoshikawa, Tokyo (JP); Akira Shinshi, Machida (JP); Kenji Ishii, Kawasaki (JP); Hiroshi Yoshinaga, Ichikawa (JP); Naoki Iwaya, Choufu (JP); Tetsuo Tokuda, Kawasaki (JP); Kenichi Hasegawa, Atsugi (JP); Yoshiki Yamaguchi, Sagamihara (JP); Shuntaroh Tamaki, Kawasaki (JP); Takahiro Imada, Yokohama (JP); Ippei Fujimoto, Ebina (JP); Takamasa Hase, Kawasaki (JP); Yutaka Ikebuchi, Chigasaki (JP)

(73) Assignee: Ricoh Company, Ltd., Tokyo (JP)

( * ) Notice: Subject to any disclaimer, the term of this patent is extended or adjusted under 35 U.S.C. 154(b) by 462 days.

(21) Appl. No.: 12/849,404

(22) Filed: Aug. 3, 2010

(65) Prior Publication Data

US 2011/0044734 A1 Feb. 24, 2011

(30) Foreign Application Priority Data

Aug. 21, 2009 (JP) ..... 2009-191730

(51) Int. Cl.
*G03G 15/20* (2006.01)

(52) U.S. Cl.
USPC ..... 399/329; 219/216; 219/619

(58) Field of Classification Search
USPC ..... 399/323, 326, 329
See application file for complete search history.

(56) References Cited

U.S. PATENT DOCUMENTS

| | | | | |
|---|---|---|---|---|
| 5,960,243 | A * | 9/1999 | Daigo et al. | 399/329 |
| 7,702,271 | B2 | 4/2010 | Yamada et al. | |
| 2002/0037186 | A1 * | 3/2002 | Tanaka | 399/322 |
| 2003/0113142 | A1 * | 6/2003 | Yoda et al. | 399/325 |
| 2004/0170454 | A1 * | 9/2004 | Gomi et al. | 399/323 |
| 2007/0292175 | A1 | 12/2007 | Shinshi | |

(Continued)

FOREIGN PATENT DOCUMENTS

| | | |
|---|---|---|
| JP | 2006-133430 | 5/2006 |
| JP | 2009-3410 | 1/2009 |
| JP | 2009-109673 | 5/2009 |

OTHER PUBLICATIONS

U.S. Appl. No. 12/685,225, filed Jan. 11, 2010, Akira Shinshi, et al.

(Continued)

*Primary Examiner* — David Gray
*Assistant Examiner* — Geoffrey Evans
(74) *Attorney, Agent, or Firm* — Oblon, Spivak, McClelland, Maier & Neustadt, L.L.P.

(57) ABSTRACT

In a fixing device, a pressing member rotates in a predetermined direction of rotation. A flexible fixing member is disposed opposite the pressing member to rotate in accordance with rotation of the pressing member. A nip formation member is provided inside a loop formed by the fixing member and pressed against the pressing member via the fixing member to form a nip between the fixing member and the pressing member through which a recording medium bearing a toner image passes. A contact member pressingly contacts an outer circumferential surface of the rotating fixing member at both ends of the fixing member in an axial direction thereof.

16 Claims, 9 Drawing Sheets

(56) References Cited

U.S. PATENT DOCUMENTS

| | | | | |
|---|---|---|---|---|
| 2008/0112739 | A1 | 5/2008 | Shinshi | |
| 2008/0175633 | A1 | 7/2008 | Shinshi | |
| 2008/0219730 | A1 | 9/2008 | Shinshi | |
| 2008/0298862 | A1 | 12/2008 | Shinshi | |
| 2009/0148204 | A1 | 6/2009 | Yoshinaga et al. | |
| 2009/0148205 | A1 | 6/2009 | Seo et al. | |
| 2009/0169232 | A1 | 7/2009 | Kunii et al. | |
| 2009/0245865 | A1 | 10/2009 | Shinshi et al. | |
| 2009/0245897 | A1 | 10/2009 | Seo et al. | |
| 2009/0297197 | A1 | 12/2009 | Hase | |
| 2009/0311016 | A1 | 12/2009 | Shinshi | |
| 2010/0061753 | A1 | 3/2010 | Hase | |
| 2010/0074667 | A1 | 3/2010 | Ehara et al. | |
| 2010/0092220 | A1 | 4/2010 | Hasegawa et al. | |
| 2010/0092221 | A1 | 4/2010 | Shinshi et al. | |
| 2011/0211876 | A1* | 9/2011 | Iwaya et al. | 399/323 |
| 2013/0164056 | A1* | 6/2013 | Imada et al. | 399/329 |
| 2013/0170877 | A1* | 7/2013 | Yoshiura et al. | 399/323 |
| 2013/0170879 | A1* | 7/2013 | Yoshinaga et al. | 399/329 |
| 2013/0170880 | A1* | 7/2013 | Gotoh et al. | 399/329 |
| 2013/0177340 | A1* | 7/2013 | Kawata et al. | 399/329 |
| 2013/0183070 | A1* | 7/2013 | Kawata et al. | 399/329 |
| 2013/0183071 | A1* | 7/2013 | Iwaya et al. | 399/329 |
| 2013/0188991 | A1* | 7/2013 | Kawata et al. | 399/122 |
| 2013/0189005 | A1* | 7/2013 | Saito et al. | 399/323 |
| 2013/0195477 | A1* | 8/2013 | Seshita et al. | 399/33 |
| 2013/0195525 | A1* | 8/2013 | Yoshinaga et al. | 399/329 |

OTHER PUBLICATIONS

U.S. Appl. No. 12/780,309, filed May 14, 2010, Kenichi Hasegawa, et al.

U.S. Appl. No. 12/662,991, filed May 14, 2010.

U.S. Appl. No. 12/841,593, filed Jul. 22, 2010, Masaaki Yoshikawa, et al.

U.S. Appl. No. 12/828,612, filed Jul. 1, 2010, Masaharu Furuya, et al.

U.S. Appl. No. 12/823,770, filed Jun. 25, 2010, Kenichi Hasegawa.

Office Action issued Feb. 3, 2012, in Chinese Patent Application No. 201010254361.0.

* cited by examiner

IMAGE FORMING APPARATUS INCORPORATING A FIXING DEVICE AND CONTACT MEMBER TO REDUCE FIXING MEMBER DEFORMATION

CROSS-REFERENCE TO RELATED APPLICATIONS

The present application is based on and claims priority to Japanese Patent Application No. 2009-191730, filed on Aug. 21, 2009, in the Japan Patent Office, which is hereby incorporated herein by reference in its entirety.

BACKGROUND OF THE INVENTION

1. Field of the Invention

Exemplary aspects of the present invention relate to a fixing device and an image forming apparatus, and more particularly, to a fixing device for fixing a toner image on a recording medium and an image forming apparatus including the fixing device.

2. Description of the Related Art

Related-art image forming apparatuses, such as copiers, facsimile machines, printers, or multifunction printers having at least one of copying, printing, scanning, and facsimile functions, typically form an image on a recording medium according to image data. Thus, for example, a charger uniformly charges a surface of an image carrier; an optical writer emits a light beam onto the charged surface of the image carrier to form an electro-static latent image on the image carrier according to the image data; a development device supplies toner to the electrostatic latent image formed on the image carrier to make the electrostatic latent image visible as a toner image; the toner image is directly transferred from the image carrier onto a recording medium or is indirectly transferred from the image carrier onto a recording medium via an intermediate transfer member; a cleaner then cleans the surface of the image carrier after the toner image is transferred from the image carrier onto the recording medium; finally, a fixing device applies heat and pressure to the recording medium bearing the toner image to fix the toner image on the recording medium, thus forming the image on the recording medium.

Such fixing device may include a metal pipe to heat the fixing device effectively. FIG. 1 is a sectional view of a fixing device 20R including a metal pipe 202. The metal pipe 202 is provided inside a loop formed by a flexible fixing belt 201 to contact an inner circumferential surface of the fixing belt 201. A heater 204 provided inside the metal pipe 202 heats the metal pipe 202, and the heated metal pipe 202 heats the fixing belt 201.

The fixing belt 201 is pressed against a pressing roller 203 to form a planar or concave-shaped nip N between the fixing belt 201 and the pressing roller 203. As the fixing belt 201 rotates counterclockwise and the pressing roller 203 rotates clockwise in FIG. 1, the fixing belt 201 and the pressing roller 203 nip and convey a recording medium bearing a toner image while applying heat and pressure to the recording medium to fix the toner image on the recording medium.

Since the rotating fixing belt 201 is configured to slide over the stationary metal pipe 202, a lubricant is applied at a gap between the fixing belt 201 and the metal pipe 202 to reduce frictional resistance between the fixing belt 201 and the metal pipe 202. However, uneven expansion of the fixing belt 201 and the metal pipe 202 due to temperature deviation or uneven deformation of the fixing belt 201 due to pressure deviation at the nip N may shift the position of the fixing belt 201 relative to the metal pipe 202 in the axial direction of the fixing belt 201. As a result, the lubricant may leak from the gap between the fixing belt 201 and the metal pipe 202 at one or both axial ends of the fixing belt 201. Consequently, the lubricant may move onto the outer circumferential surface of the fixing belt 201 that contacts the pressing roller 203, resulting in slippage of the fixing belt 201 on the pressing roller 203. Moreover, the lubricant may farther move to the recording medium passing through the nip N, resulting in formation of a faulty toner image on the recording medium, or jamming or wrinkling of the recording medium.

On the other hand, after the flexible fixing belt 201 moves along the concave-shaped nip N that corresponds to the curvature of the pressing roller 203, the fixing belt 201 separates from the metal pipe 202 at a position downstream from the nip N in the direction of rotation of the fixing belt 201, creating an excessively large gap A between the fixing belt 201 and the metal pipe 202 as illustrated in FIG. 1 and causing the recording medium discharged from the nip N to contact the fixing belt 201 for longer time. Consequently, excessive heat is transmitted from the fixing belt 201 to the recording medium, generating hot offset of the toner image on the recording medium. Moreover, the large gap A may disturb separation of the recording medium from the fixing belt 201.

BRIEF SUMMARY OF THE INVENTION

This specification describes below an improved fixing device. In one exemplary embodiment of the present invention, the fixing device includes a pressing member, a flexible fixing member, a nip formation member, and a contact member. The pressing member rotates in a predetermined direction of rotation. The flexible fixing member is disposed opposite the pressing member and rotates in accordance with rotation of the pressing member. The nip formation member is provided inside a loop formed by the fixing member and pressed against the pressing member via the fixing member to form a nip between the fixing member and the pressing member through which a recording medium bearing a toner image passes. The contact member pressingly contacts an outer circumferential surface of the rotating fixing member at both ends of the fixing member in an axial direction thereof.

This specification further describes an image forming apparatus. In one exemplary embodiment, the image forming apparatus includes an image forming device that forms a toner image on a recording medium and a fixing device that fixes the toner image on the recording medium. The fixing device includes a pressing member, a flexible fixing member, a nip formation member, and a contact member. The pressing member rotates in a predetermined direction of rotation. The flexible fixing member is disposed opposite the pressing member and rotates in accordance with rotation of the pressing member. The nip formation member is provided inside a loop formed by the fixing member and pressed against the pressing member via the fixing member to form a nip between the fixing member and the pressing member through which the recording medium bearing the toner image passes. The contact member pressingly contacts an outer circumferential surface of the fixing member at both ends of the fixing member in an axial direction thereof.

BRIEF DESCRIPTION OF THE DRAWINGS

A more complete appreciation of the invention and the many attendant advantages thereof will be readily obtained as the same becomes better understood by reference to the following detailed description when considered in connection with the accompanying drawings, wherein.

DETAILED DESCRIPTION OF THE INVENTION

Figure 1:
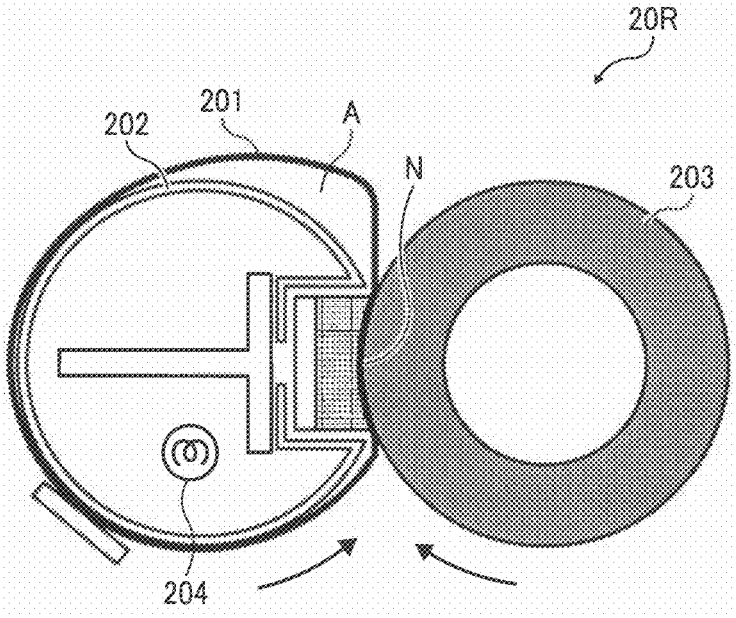
FIG. 1 RELATED ART
FIG. 1 is a sectional view of a related-art fixing device.

In describing exemplary embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner.

Figure 2:
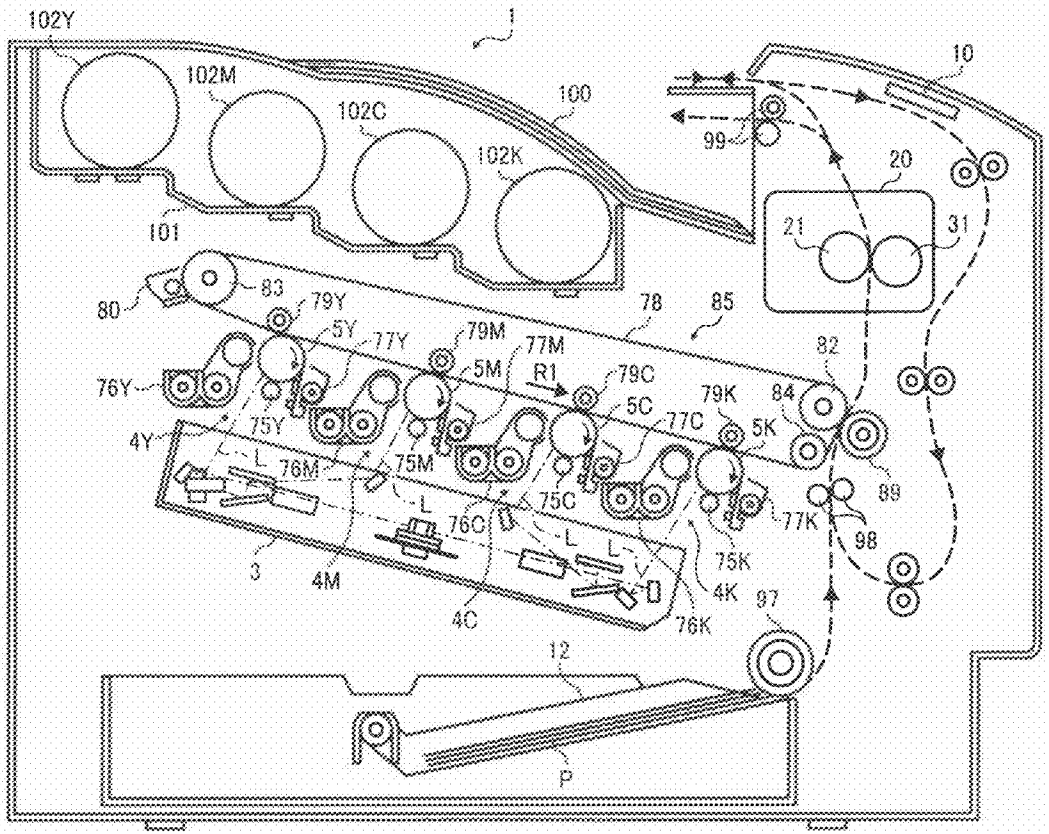
FIG. 2 is a schematic view of an image forming apparatus according to an exemplary embodiment of the present invention.

Referring now to the drawings, wherein like reference numerals designate identical or corresponding parts throughout the several views, in particular to FIG. 2, an image forming apparatus 1 according to an exemplary embodiment of the present invention is explained.

FIG. 2 is a schematic view of the image forming apparatus 1. As illustrated in FIG. 2, the image forming apparatus 1 may be a copier, a facsimile machine, a printer, a multifunction printer having at least one of copying, printing, scanning, plotter, and facsimile functions, or the like. According to this exemplary embodiment of the present invention, the image forming apparatus 1 is a tandem color printer for forming a color image on a recording medium.

As illustrated in FIG. 2, the image forming apparatus 1 includes an exposure device 3, image forming devices 4Y, 4M, 4C, and 4K, a controller 10, a paper tray 12, a fixing device 20, an intermediate transfer unit 85, a second transfer roller 89, a feed roller 97, a registration roller pair 98, an output roller pair 99, a stack portion 100, and a toner bottle holder 101.

The image forming devices 4Y, 4M, 4C, and 4K include photoconductive drums 5Y, 5M, 5C, and 5K, chargers 75Y, 75M, 75C, and 75K, development devices 76Y, 76M, 76C, and 76K, and cleaners 77Y, 77M, 77C, and 77K, respectively.

The fixing device 20 includes a fixing belt 21 and a pressing roller 31.

The intermediate transfer unit 85 includes an intermediate transfer belt 78, first transfer bias rollers 79Y, 79M, 79C, and 79K, an intermediate transfer cleaner 80, a second transfer backup roller 82, a cleaning backup roller 83, and a tension roller 84.

The toner bottle holder 101 includes toner bottles 102Y, 102M, 102C, and 102K.

The toner bottle holder 101 is provided in an upper portion of the image forming apparatus 1. The four toner bottles 102Y, 102M, 102C, and 102K contain yellow, magenta, cyan, and black toners, respectively, and are detachably attached to the toner bottle holder 101 so that the toner bottles 102Y, 102M, 102C, and 102K are replaced with new ones, respectively.

The intermediate transfer unit 85 is provided below the toner bottle holder 101. The image forming devices 4Y, 4M, 4C, and 4K are arranged opposite the intermediate transfer belt 78 of the intermediate transfer unit 85, and form yellow, magenta, cyan, and black toner images, respectively.

In the image forming devices 4Y, 4M, 4C, and 4K, the chargers 75Y, 75M, 75C, and 75K, the development devices 76Y, 76M, 76C, and 76K, the cleaners 77Y, 77M, 77C, and 77K, and dischargers surround the photoconductive drums 5Y, 5M, 5C, and 5K, respectively. Image forming processes including a charging process, an exposure process, a development process, a first transfer process, and a cleaning process are performed on the rotating photoconductive drums 5Y, 5M, 5C, and 5K to form yellow, magenta, cyan, and black toner images on the photoconductive drums 5Y, 5M, 5C, and 5K, respectively.

The following describes the image forming processes performed on the photoconductive drums 5Y, 5M, 5C, and 5K.

A driving motor drives and rotates the photoconductive drums 5Y, 5M, 5C, and 5K clockwise in FIG. 2. In the charging process, the chargers 75Y, 75M, 75C, and 75K are disposed opposite the photoconductive drums 5Y, 5M, 5C, and 5K, respectively, and uniformly charge surfaces of the photoconductive drums 5Y, 5M, 5C, and 5K.

In the exposure process, the exposure device 3 emits laser beams L onto the charged surfaces of the photoconductive drums 5Y, 5M, 5C, and 5K to expose the charged surfaces of the photoconductive drums 5Y, 5M, 5C, and 5K, respectively, so as to form thereon electrostatic latent images corresponding to yellow, magenta, cyan, and black colors, respectively.

In the development process, the development devices 76Y, 76M, 76C, and 76K render the electrostatic latent images formed on the surfaces of the photoconductive drums 5Y, 5M, 5C, and 5K visible as yellow, magenta, cyan, and black toner images, respectively.

In the first transfer process, the first transfer bias rollers 79Y, 79M, 79C, and 79K transfer and superimpose the yellow, magenta, cyan, and black toner images formed on the photoconductive drums 5Y, 5M, 5C, and 5K onto the intermediate transfer belt 78. Thus, a color toner image is formed on the intermediate transfer belt 78.

After the transfer of the yellow, magenta, cyan, and black toner images, the surfaces of the photoconductive drums 5Y, 5M, 5C, and 5K from which the yellow, magenta, cyan, and black toner images are transferred reach positions at which the cleaners 77Y, 77M, 77C, and 77K are disposed opposite the photoconductive drums 5Y, 5M, 5C, and 5K, respectively. In the cleaning process, cleaning blades included in the cleaners 77Y, 77M, 77C, and 77K mechanically collect residual toner remaining on the surfaces of the photoconductive drums 5Y, 5M, 5C, and 5K from the photoconductive drums 5Y, 5M, 5C, and 5K, respectively. Thereafter, dischargers remove residual potential on the surfaces of the photoconductive drums 5Y, 5M, 5C, and 5K, respectively, thus completing a single sequence of image forming processes performed on the photoconductive drums 5Y, 5M, 5C, and 5K.

The following describes a series of transfer processes performed on the intermediate transfer belt 78.

The intermediate transfer unit 85 includes the endless, intermediate transfer belt 78, the four first transfer bias rollers 79Y, 79M, 79C, and 79K, the second transfer backup roller 82, the cleaning backup roller 83, the tension roller 84, and the intermediate transfer cleaner 80.

The intermediate transfer belt 78 is supported by and stretched over the second transfer backup roller 82, the cleaning backup roller 83, and the tension roller 84. The second transfer backup roller 82 drives and rotates the intermediate transfer belt 78 in a direction R1.

The first transfer bias rollers 79Y, 79M, 79C, and 79K and the photoconductive drums 5Y, 5M, 5C, and 5K sandwich the intermediate transfer belt 78 to form first transfer nips, respectively. The first transfer bias rollers 79Y, 79M, 79C, and 79K are applied with a transfer bias having a polarity opposite to a polarity of toner forming the yellow, magenta, cyan, and black toner images on the photoconductive drums 5Y, 5M, 5C, and 5K, respectively.

As the intermediate transfer belt 78 moves in the direction R1 and passes through the first transfer nips formed between the intermediate transfer belt 78 and the photoconductive drums 5Y, 5M, 5C, and 5K successively, the yellow, magenta, cyan, and black toner images formed on the photoconductive drums 5Y, 5M, 5C, and 5K, respectively, are transferred and superimposed onto the intermediate transfer belt 78 at the first transfer nips formed between the photoconductive drums 5Y, 5M, 5C, and 5K and the intermediate transfer belt 78. Thus, a color toner image is formed on the intermediate transfer belt 78.

The paper tray 12 is provided in a lower portion of the image forming apparatus 1, and loads a plurality of recording media P (e.g., transfer sheets). The feed roller 97 rotates counterclockwise in FIG. 2 to feed an uppermost recording medium P of the plurality of recording media P loaded on the paper tray 12 toward the registration roller pair 98.

The registration roller pair 98, which stops rotating temporarily, stops the uppermost recording medium P fed by the feed roller 97. For example, a roller nip of the registration roller pair 98 contacts and stops a leading edge of the recording medium P temporarily. The registration roller pair 98 resumes rotating to feed the recording medium P to a second transfer nip, formed between the second transfer roller 89 and the intermediate transfer belt 78, as the color toner image formed on the intermediate transfer belt 78 reaches the second transfer nip.

After the first transfer process, an outer circumferential surface of the intermediate transfer belt 78 bearing the color toner image reaches a position at which the second transfer roller 89 is disposed opposite the intermediate transfer belt 78. At this position, the second transfer roller 89 and the second transfer backup roller 82 sandwich the intermediate transfer belt 78 to form the second transfer nip between the second transfer roller 89 and the intermediate transfer belt 78. At the second transfer nip, the second transfer roller 89 transfers the color toner image formed on the intermediate transfer belt 78 onto the recording medium P fed by the registration roller pair 98 in a second transfer process. After the second transfer process, when the outer circumferential surface of the intermediate transfer belt 78 reaches a position at which the intermediate transfer cleaner 80 is disposed opposite the intermediate transfer belt 78, the intermediate transfer cleaner 80 collects residual toner from the intermediate transfer belt 78, thus completing a single sequence of transfer processes performed on the intermediate transfer belt 78.

The recording medium P bearing the color toner image is sent to the fixing device 20. In the fixing device 20, the fixing belt 21 and the pressing roller 31 apply heat and pressure to the recording medium P to fix the color toner image on the recording medium P.

Thereafter, the fixing device 20 feeds the recording medium P bearing the fixed color toner image toward the output roller pair 99. The output roller pair 99 discharges the recording medium P to an outside of the image forming apparatus 1, that is, the stack portion 100. Thus, the recording media P discharged by the output roller pair 99 are stacked on the stack portion 100 successively to complete a single sequence of image forming processes performed by the image forming apparatus 1.

The controller 10 controls operation of the components of the image forming apparatus 1.

Figure 3:
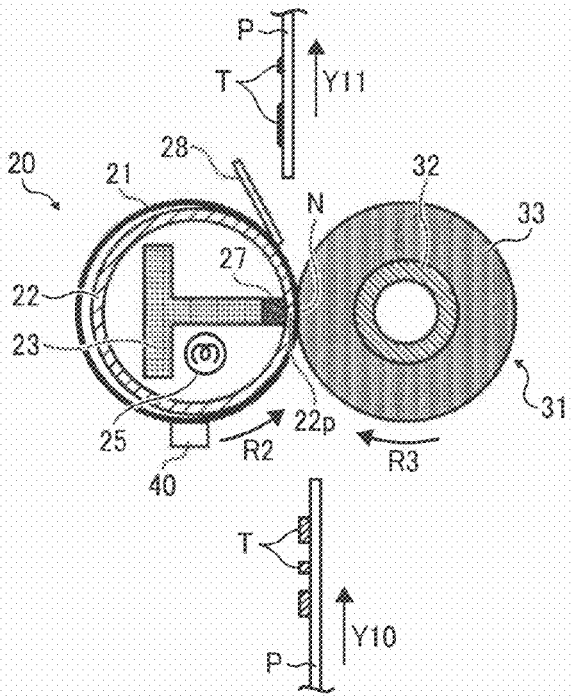
FIG. 3 is a sectional view of a fixing device included in the image forming apparatus shown in FIG. 2.
Figure 4:
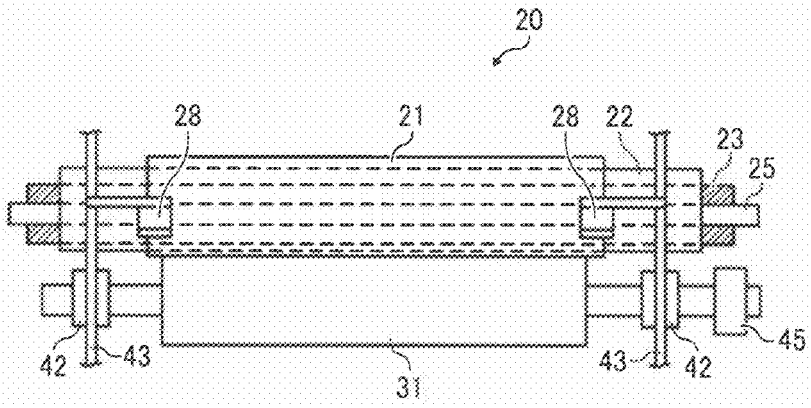
FIG. 4 is a plan view of the fixing device shown in FIG. 3.

Referring to FIGS. 3 and 4, the following describes the structure and operation of the fixing device 20.

FIG. 3 is a sectional view of the fixing device 20. As illustrated in FIG. 3, the fixing device 20 further includes a holding member 22, a reinforcement member 23, a heater 25, a heat insulator 27, scrapers 28, and a temperature sensor 40. The holding member 22 includes a planar portion 22*p*. The pressing roller 31 includes a metal core 32 and an elastic layer 33.

FIG. 4 is a plan view of the fixing device 20. As illustrated in FIG. 4, the fixing device 20 further includes bearings 42, side plates 43, and a gear 45.

As illustrated in FIG. 3, the fixing device 20 includes the fixing belt 21 serving as a fixing member, the holding member 22, the reinforcement member 23 serving as a nip formation member, the heat insulator 27, the heater 25 serving as a heater or a heat source, the scraper 28 serving as a contact member, the pressing roller 31 serving as a pressing member, and the temperature sensor 40.

The fixing belt 21 may be a thin, flexible endless belt that rotates or moves counterclockwise in FIG. 3 in a rotation direction R2. The fixing belt 21 is constructed of a base layer, an elastic layer, and a release layer, and has a total thickness not greater than about 1 mm. The elastic layer is provided on the base layer. The release layer is provided on the elastic layer. The base layer of the fixing belt 21 has a thickness in a range of from about 30 μm to about 50 μm, and includes a metal material such as nickel and/or stainless steel, and/or a resin material such as polyimide.

The elastic layer of the fixing belt 21 has a thickness in a range of from about 100 μm to about 300 μm, and includes a rubber material such as silicon rubber, silicon rubber foam, and/or fluorocarbon rubber. The elastic layer eliminates or reduces slight surface asperities of the fixing belt 21 at a nip N formed between the fixing belt 21 and the pressing roller 31. Accordingly, heat is uniformly transmitted from the fixing belt 21 to a toner image T on a recording medium P, suppressing formation of a rough image such as an orange peel image.

The release layer of the fixing belt 21 has a thickness in a range of from about 10 μm to about 50 μm, and includes tetrafluoroethylene perfluoroalkylvinylether copolymer (PFA), polytetrafluoroethylene (PTFE), polyimide, polyetherimide, and/or polyether sulfide (PES). The release layer releases or separates the toner image T from the fixing belt 21.

The fixing belt 21 has a loop diameter in a range of from about 15 mm to about 120 mm. According to this exemplary embodiment, the fixing belt 21 has a loop diameter of about 30 mm. As illustrated in FIG. 3, the heater 25, the holding member 22, the reinforcement member 23, and the heat insulator 27 are provided inside a loop formed by the fixing belt 21. In other words, the heater 25, the holding member 22, the reinforcement member 23, and the heat insulator 27 do not face an outer circumferential surface of the fixing belt 21, but face an inner circumferential surface of the fixing belt 21. The holding member 22 reinforced by the reinforcement member 23 serving as a nip formation member presses the fixing belt 21 against the pressing roller 31 to form the nip N between the fixing belt 21 and the pressing roller 31.

The heat insulator 27 is provided between the reinforcement member 23 and the holding member 22 to prevent heat from being transmitted from the holding member 22 serving as a heat conductor to the reinforcement member 23 so as to suppress degradation of heating efficiency of the holding member 22 for heating the fixing belt 21. The heat insulator 27 includes a heat-resistant, high-insulating material such as rubber, resin, felt, or ceramic sheet.

The holding member 22 is provided inside the fixing belt 21, and is pressed against the pressing roller 31 via the fixing belt 21 to form the nip N between the fixing belt 21 and the pressing roller 31. As illustrated in FIG. 4, both ends of the holding member 22 in a width direction, that is, an axial direction, of the holding member 22 are fixed to and supported by the side plates 43 of the fixing device 20, respectively.

The holding member 22 has the planar portion 22*p* that faces the nip N. In other words, an opposing surface portion of the holding member 22 which faces the pressing roller 31 at the nip N has a planar shape. Accordingly, the nip N is substantially parallel to an image side of the recording medium P to enhance fixing property, that is, to adhere the recording medium P to the fixing belt 21 more precisely, and provides greater curvature of the fixing belt 21 at an exit side of the nip N, thus facilitating separation of the recording medium P discharged from the nip N from the fixing belt 21.

It is to be noted that although in this exemplary embodiment, the holding member 22 has the planar shape at the nip N, alternatively the holding member 22 may have a concave shape at the nip N. In other words, the opposing surface portion of the holding member 22 which faces the pressing roller 31 may correspond to a curvature of the pressing roller 31. Accordingly, the recording medium P is discharged from the nip N according to the curvature of the pressing roller 31. Consequently, the recording medium P is not adhered to the fixing belt 21 after the fixing process, and therefore separates from the fixing belt 21.

According to this exemplary embodiment, the reinforcement member 23 reinforcing the holding member 22 at the nip N is provided inside the fixing belt 21 facing the inner circumferential surface of the fixing belt 21. As illustrated in FIG. 4, a width of the reinforcement member 23 in a width direction of the reinforcement member 23 is equivalent to or greater than a width of the holding member 22 in the width direction of the holding member 22. Both ends of the reinforcement member 23 in the width direction of the reinforcement member 23 are fixed to and supported by the side plates 43 of the fixing device 20, respectively.

The reinforcement member 23 is pressed against the pressing roller 31 via the holding member 22 and the fixing belt 21 to suppress substantial deformation of the holding member 22 at the nip N due to pressure applied by the pressing roller 31. If the reinforcement member 23 is not provided, the holding member 22 may be bent by pressure applied by the pressing roller 31. Specifically, pressure applied to both ends of the holding member 22 in the width direction of the holding member 22 bends a center portion of the holding member 22 in the width direction of the holding member 22 substantially. For example, use of a thin holding member to increase heating efficiency for heating the fixing belt 21 may result in the holding member 22 being bent substantially.

To address this problem, according to this exemplary embodiment, the reinforcement member 23 restricts deformation of the holding member 22. Accordingly, even when the thin holding member 22 is used, bending of the holding member 22 is suppressed. Consequently, the bent holding member 22 may not scratch the inner circumferential surface of the fixing belt 21 with a great force or may not increase a driving torque of the fixing belt 21.

The reinforcement member 23 may include a metal material having great mechanical strength, such as stainless steel and/or iron. Further, the reinforcement member 23 may have a greater thickness in cross-section in a pressing direction in which the pressing roller 31 applies pressure to the reinforcement member 23. Accordingly, the reinforcement member 23 may have a greater section modulus to provide increased mechanical strength.

An opposing surface portion of the reinforcement member 23 which faces the heater 25 may be provided with a heat insulator or mirror-finished partially or wholly. Accordingly, heat generated by the heater 25 toward the reinforcement member 23 to heat the reinforcement member 23 is used to heat the holding member 22 to improve heating efficiency of the holding member 22 for heating the fixing belt 21.

The heater 25 serving as a heat source may be a halogen heater and/or a carbon heater. As illustrated in FIG. 4, both ends of the heater 25 in a width direction of the heater 25, which is parallel to the axial direction of the fixing belt 21, are fixedly mounted on the side plates 43 of the fixing device 20, respectively. Alternatively, an induction heater may be used as a heat source.

Radiation heat generated by the heater 25, which is controlled by the controller 10 of the image forming apparatus 1 depicted in FIG. 2, heats the holding member 22. The holding member 22 serving as a heat conductor heats substantially the entire fixing belt 21. Accordingly, heat is transmitted from the outer circumferential surface of the heated fixing belt 21 to the toner image T on the recording medium P.

As illustrated in FIG. 3, the temperature sensor 40, which may be a thermistor, faces the outer circumferential surface of the fixing belt 21 to detect a temperature of the outer circumferential surface of the fixing belt 21. The controller 10 depicted in FIG. 2 controls the heater 25 according to detection results provided by the temperature sensor 40 so as to adjust the temperature (e.g., a fixing temperature) of the fixing belt 21 to a desired temperature.

As illustrated in FIG. 3, the holding member 22 contacts or is disposed close to the whole inner circumferential surface of the fixing belt 21 including a surface portion thereof provided at the nip N. The holding member 22 is heated by radiation heat generated by the heater 25, and heats the fixing belt 21. The holding member 22 may include a metallic heat conductor, that is, a metal having a desired heat conductivity such as aluminum, iron, and/or stainless steel.

A gap δ formed between the fixing belt 21 and the holding member 22 at a position other than the nip N may have a size greater than 0 mm and not greater than 1 mm, which is shown as $0\ \text{mm} < \delta \leq 1\ \text{mm}$. A lubricant, such as silicon oil or fluorine grease, is applied at the gap 5, so as to decrease wear of the fixing belt 21 and the holding member 22 as the fixing belt 21 slidably contacts the holding member 22.

The holding member 22 provided close to the fixing belt 21 maintains a circular shape of the flexible fixing belt 21 substantially to reduce degradation and damage of the fixing belt 21 due to deformation of the fixing belt 21.

The scrapers 28 serving as a contact member may be a Mylar (registered trademark) or rubber blade. The scrapers 28 are provided at both ends of the fixing belt 21, that is, at positions near both edges of the fixing belt 21 in the width direction, that is, an axial direction, of the fixing belt 21, respectively, and slidably and pressingly contact the rotating fixing belt 21 and press the fixing belt 21 against the holding member 22.

Accordingly, the scrapers 28 serve as a stopper to prevent the fixing belt 21 from moving or shifting in the width direction of the fixing belt 21. Consequently, the fixing belt 21 moves stably, and the lubricant does not leak from the gap between the fixing belt 21 and the holding member 22. However, even when the lubricant leaks from the gap, the lubricant is scraped by the scrapers 28.

Like the fixing belt 201 illustrated in FIG. 1, the flexible fixing belt 21 may be deformed near the exit of the nip N at which the recording medium P is discharged from the nip N. Specifically, the fixing belt 21 corresponds to the planar shape of the nip N and may enlarge the gap A between the fixing belt 21 and the holding member 22 excessively. To address this problem, according to this exemplary embodiment, the scrapers 28 slidably and pressingly contact the rotating fixing belt 21 at both ends of the fixing belt 21, that is, at the positions near both edges of the fixing belt 21 in the width direction of the fixing belt 21 at which the enlarged gap A may generate between the fixing belt 21 and the holding member 22 in a circumferential direction of the fixing belt 21. Accordingly, rigidity of the fixing belt 21 provided through the width direction of the fixing belt 21 suppresses generation of the enlarged gap A and deformation of the fixing belt 21 within an allowable range throughout the width direction of the fixing belt 21, that is, not only at both ends of the fixing belt 21 slidably contacted by the scrapers 28 but also at a center portion of the fixing belt 21 in the width direction of the fixing belt 21 through which the recording medium P passes.

As illustrated in FIG. 4, the scrapers 28 are attached to the side plates 43 of the fixing device 20, respectively. The side plate 43 is a rigid material that supports the components of the fixing device 20. The side plates 43 also position the scrapers 28 with respect to the fixing belt 21. Accordingly, the scrapers 28 mounted on the side plates 43 slide over the fixing belt 21 precisely to stabilize movement of the fixing belt 21 and reduce leakage of the lubricant from the gap between the fixing belt 21 and the holding member 22.

As illustrated in FIG. 3, the pressing roller 31 has a loop diameter of about 30 mm. In the pressing roller 31, the elastic layer 33 is provided on the hollow metal core 32. The elastic layer 33 may be silicon rubber foam, silicon rubber, and/or fluorocarbon rubber. A thin release layer including PFA and/or PTFE may be provided on the elastic layer 33 to serve as a surface layer.

The pressing roller 31 is pressed against the fixing belt 21 to form the desired nip N between the pressing roller 31 and the fixing belt 21. As illustrated in FIG. 4, the gear 45 engaging a driving gear of a driving mechanism is mounted on the pressing roller 31. Thus, the driving mechanism rotates the pressing roller 31 clockwise in FIG. 3 in a rotation direction R3.

Both ends of the pressing roller 31 in a width direction of the pressing roller 31, that is, in an axial direction of the pressing roller 31, are rotatively supported by the side plates 43 of the fixing device 20 via the bearings 42, respectively. A heat source, such as a halogen heater, may be provided inside the pressing roller 31, but is not necessary.

When the elastic layer 33 of the pressing roller 31 includes a sponge material such as silicon rubber foam, the pressing roller 31 applies decreased pressure to the fixing belt 21 at the nip N to decrease bending of the holding member 22. Further, the sponge material of the pressing roller 31 provides increased heat insulation, and therefore heat is not transmitted from the fixing belt 21 to the pressing roller 31 easily, improving heating efficiency for heating the fixing belt 21.

According to this exemplary embodiment, the loop diameter of the fixing belt 21 is equivalent to the loop diameter of the pressing roller 31. Alternatively, the loop diameter of the fixing belt 21 may be smaller than the loop diameter of the pressing roller 31. In this case, a curvature of the fixing belt 21 is smaller than a curvature of the pressing roller 31 at the nip N, and therefore a recording medium P separates from the fixing belt 21 easily when the recording medium P is discharged from the nip N.

Referring to FIG. 3, the following describes operation of the fixing device 20 having the above-described structure.

When the image forming apparatus 1 depicted in FIG. 2 is powered on, power is supplied to the heater 25, and the pressing roller 31 starts rotating in the rotation direction R3. Accordingly, friction between the pressing roller 31 and the fixing belt 21 rotates the fixing belt 21 in the rotation direction R2. In other words, the fixing belt 21 is driven by the rotating pressing roller 31.

While the fixing belt 21 rotates in the rotation direction R2, the scrapers 28 slide over the fixing belt 21 to stabilize movement of the fixing belt 21. Even if the fixing belt 21 is shifted relative to the holding member 22 in the width direction of the fixing belt 21, and therefore the lubricant leaks from the gap between the fixing belt 21 and the holding member 22 at both ends of the fixing belt 21 in the width direction of the fixing belt 21, the scrapers 28 scrape the lubricant from the fixing belt 21.

Thereafter, a recording medium P is sent from the paper tray 12 (depicted in FIG. 2) toward the second transfer roller 89 (depicted in FIG. 2) so that a color toner image (e.g., a toner image T) is transferred from the intermediate transfer belt 78 (depicted in FIG. 2) onto the recording medium P. A guide guides the recording medium P bearing the unfixed toner image T in a direction Y10 so that the recording medium P bearing the unfixed toner image T enters the nip N formed between the fixing belt 21 and the pressing roller 31 pressed against the fixing belt 21.

The fixing belt 21 heated by the heater 25 via the holding member 22 applies heat to the recording medium P bearing the unfixed toner image T. Simultaneously, the holding member 22 and the pressing roller 31 apply pressure to the recording medium P bearing the unfixed toner image T. Thus, the heat and the pressure fix the unfixed toner image T on the recording medium P.

The scrapers 28 adjust the gap between the fixing belt 21 and the holding member 22 at the exit of the nip N within a predetermined range. Accordingly, the recording medium P bears the desired toner image T fixed on the recording medium P when the recording medium P is discharged from the nip N. Thereafter, the recording medium P passes between the pressing roller 31 and the scrapers 28 also serving as a separator for separating the recording medium P from the fixing belt 21, and is conveyed in a direction Y11.

Referring to FIGS. 5 to 11, the following describes the structure of the scrapers 28 and variations thereof.

Figure 5:
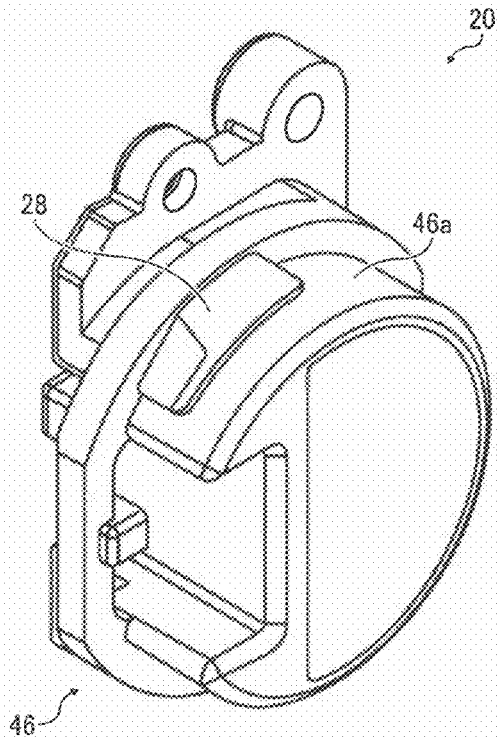
FIG. 5 is a perspective view of a flange and a scraper included in the fixing device shown in FIG. 4.
Figure 6:
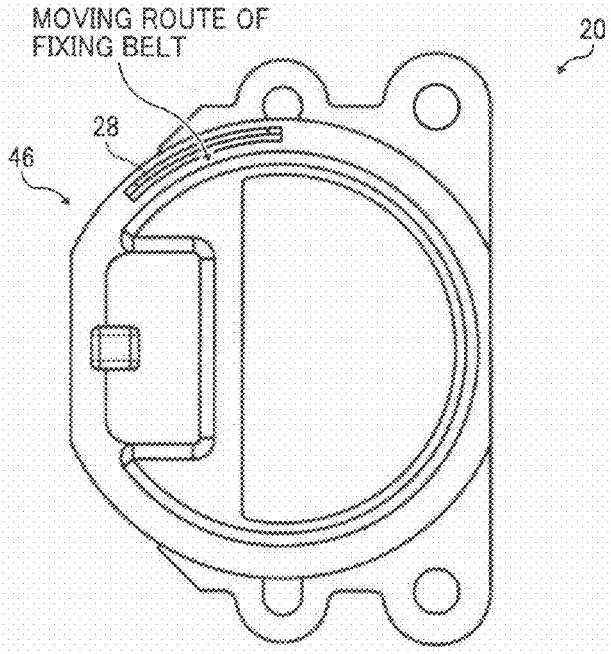
FIG. 6 is a front view of the flange and the scraper shown in FIG. 5.
Figure 7:
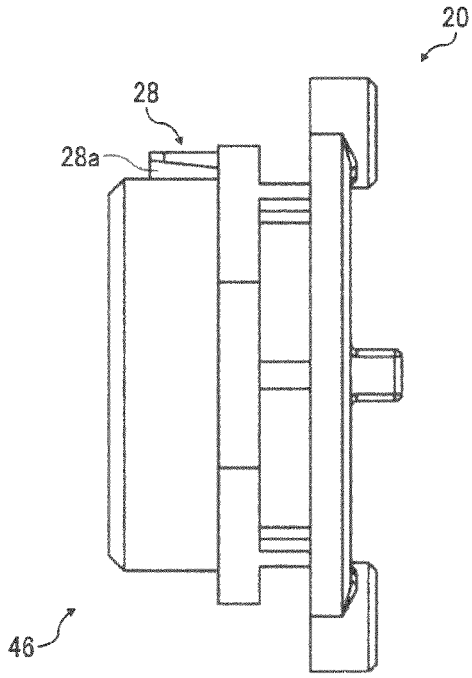
FIG. 7 is a side view of the flange and the scraper shown in FIG. 5.

FIG. 5 is a partial perspective view of the fixing device 20. As illustrated in FIG. 5, the fixing device 20 further includes flanges 46. The flange 46 includes a C-shaped portion 46*a*. FIG. 6 is a partial front view of the fixing device 20. FIG. 7 is a partial side view of the fixing device 20. As illustrated in FIG. 7, the scraper 28 includes a bevel 28*a*.

As illustrated in FIGS. 5 to 7, the scraper 28 is mounted on the flange 46 serving as a support for the scraper 28. The flange 46 causes the holding member 22 to be supported by the side plate 43 as illustrated in FIG. 4. The flange 46 is attached to the side plate 43 disposed opposite the flange 46 by a fastener such as a screw. Specifically, the C-shaped portion 46*a* of the flange 46 is inserted into the holding member 22 at each end of the holding member 22 in the width direction of the holding member 22 to support the holding member 22.

Each end of the fixing belt 21 in the width direction of the fixing belt 21 is provided between the scraper 28 and each end of the holding member 22 in the width direction of the holding member 22 which is supported by the flange 46. Accordingly, the gap generated between the fixing belt 21 and the holding member 22 at the exit of the nip N, which is generated by deformation of the fixing belt 21, does not exceed the gap between the scraper 28 and the holding member 22.

As illustrated in FIG. 7, the bevel 28*a* of the scraper 28 is provided with respect to the fixing belt 21 in such a manner that a gap between the bevel 28*a* and the fixing belt 21 becomes greater from a bottom of the bevel 28*a* attached to the flange 46 toward a center of the fixing belt 21 in the width direction of the fixing belt 21. Accordingly, even when the rotating fixing belt 21 is shifted in the width direction of the fixing belt 21, drag applied to the fixing belt 21 by the scraper 28 contacting the rotating fixing belt 21 moves the shifted fixing belt 21 back toward the center of the fixing belt 21 in the width direction of the fixing belt 21. Consequently, the fixing belt 21 moves stably to reduce leakage of the lubricant from the gap between the fixing belt 21 and the holding member 22. Moreover, even when the lubricant leaks from the gap to the outer circumferential surface of the fixing belt 21, the scrapers 28 sliding over the flexible fixing belt 21 scrape the leaked lubricant from the outer circumferential surface of the fixing belt 21 at both ends of the fixing belt 21 in the width direction of the fixing belt 21.

Figure 8:
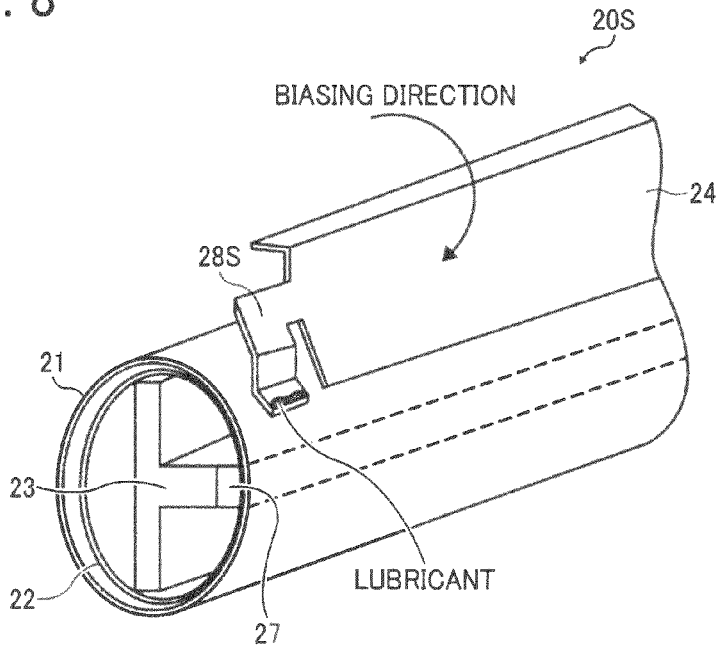
FIG. 8 is a perspective view of a fixing device illustrating a variation of the scraper shown in FIG. 5.

FIG. 8 is a perspective view of a fixing device 20S including a scraper 28S as one variation of the scraper 28. As illustrated in FIG. 8, the fixing device 20S includes the scrapers 28S replacing the scrapers 28 depicted in FIG. 5 and a separation plate 24 replacing the flanges 46 depicted in FIG. 5. The other elements of the fixing device 20S are equivalent to the elements of the fixing device 20 depicted in FIG. 4.

The scrapers 28S, serving as a contact member that slidably and pressingly contacts the rotating fixing belt 21, are provided on the separation plate 24. The separation plate 24 is provided at a position equivalent to the position of the scraper 28 depicted in FIG. 3, and serves as a separator that separates the recording medium P discharged from the nip N from the fixing belt 21. In other words, the separation plate 24 facilitates separation of the recording medium P from the fixing belt 21 by peeling the recording medium P off the fixing belt 21. A front edge of the separation plate 24 is directed downward to face the outer circumferential surface of the fixing belt 21.

The scrapers 28S are provided on both ends of the separation plate 24 in a width direction of the separation plate 24 parallel to the axial direction of the fixing belt 21, respectively, in such a manner that the scrapers 28S and the separation plate 24 are integrated into a unit. The separation plate 24 is rotatively provided on the side plates 43 (depicted in FIG. 4) of the fixing device 20S. Specifically, the separation plate 24 is provided near the fixing belt 21 in such a manner that the front edge of the separation plate 24 does not contact the fixing belt 21, so that the separation plate 24 prevents the recording medium P from winding around the fixing belt 21 at a center portion of the fixing belt 21 in the width direction of the fixing belt 21 through which the recording medium P passes.

At both ends of the separation plate 24 in the width direction of the separation plate 24 through which the recording medium P does not pass, biasing members (e.g., torsion coil springs) bias the scrapers 28S against the fixing belt 21 to cause the scrapers 28S to slide over the fixing belt 21. The scrapers 28S are disposed at positions at which a substantial gap arises between the fixing belt 21 and the holding member 22 in the circumferential direction of the fixing belt 21. Accordingly, the scrapers 28S, serving as a contact member that contacts the rotating fixing belt 21 by applying pressure to the fixing belt 21 at the positions at which the substantial gap arises between the fixing belt 21 and the holding member 22, effectively facilitate stable movement of the fixing belt 21 and reduce leakage of the lubricant from the gap between the fixing belt 21 and the holding member 22.

In the fixing device 20S, even when recording media P of various thicknesses passing through the nip N generate deviation of a trail on which the fixing belt 21 moves in the circumferential direction thereof, the scrapers 28S slide over the fixing belt 21 while the scrapers 28S receive a biasing force from the biasing members. Accordingly, the fixing belt 21 moves stably and reduces leakage of the lubricant from the gap between the fixing belt 21 and the holding member 22.

When the separation plate 24 is detached from the fixing device 20S, a user can remove the lubricant from the scrapers 28S easily for regular maintenance.

Figure 9:
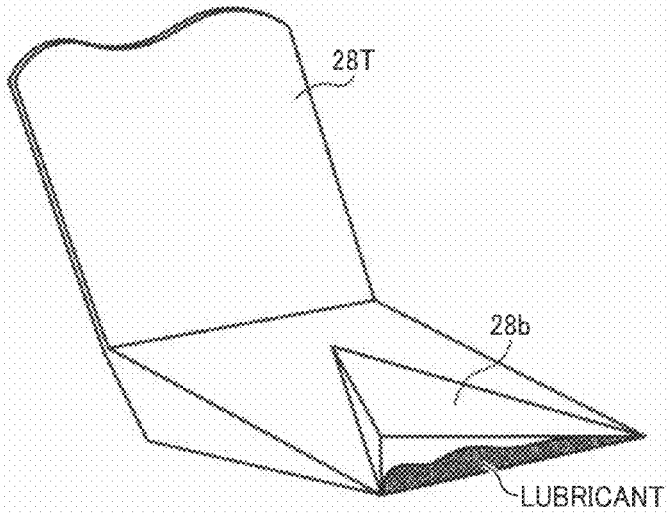
FIG. 9 is a perspective view of another variation of the scraper shown in FIG. 5.

FIG. 9 is a perspective view of a scraper 28T as another variation of the scraper 28 depicted in FIG. 3. As illustrated in FIG. 9, the scraper 28T includes a concave portion 28*b*. The concave portion 28*b* is provided on a side of the scraper 28T opposite a contact side of the scraper 28T, serving as a contact member, that slidably and pressingly contacts the rotating fixing belt 21. The concave portion 28*b* receives and stores the lubricant scraped by the scraper 28T to suppress scattering of the lubricant from the scraper 28T and returning of the lubricant to the outer circumferential surface of the fixing belt 21. An absorption member (e.g., felt or cloth impregnated with amine) for absorbing the lubricant may be provided on the concave portion 28*b*.

Figure 10:
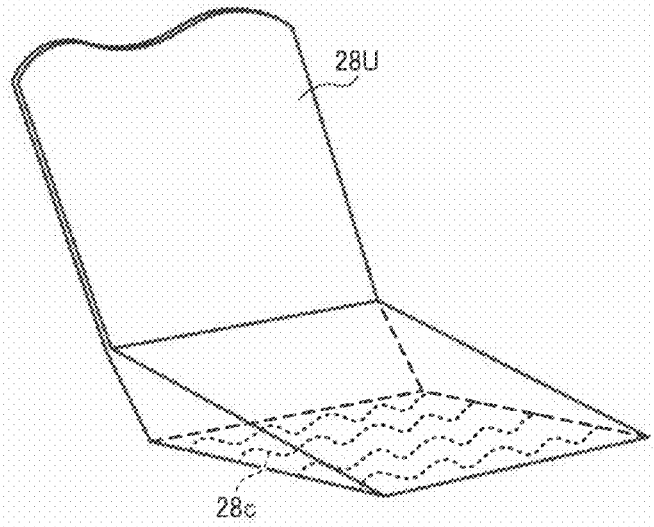
FIG. 10 is a perspective view of yet another variation of the scraper shown in FIG. 5.

FIG. 10 is a perspective view of a scraper 28U as yet another variation of the scraper 28 depicted in FIG. 3. As illustrated in FIG. 10, the scraper 28U includes an uneven portion 28*c*. Ridges and grooves on a contact surface of the scraper 28U serving as a contact member that slidably and pressingly contacts the rotating fixing belt 21 form the uneven portion 28*c*.

According to this exemplary embodiment, the uneven portion 28*c* has a wave pattern. Alternatively, the uneven portion 28*c* may have any pattern formed of projections and depressions arranged substantially perpendicular to the rotation direction R2 of the fixing belt 21.

The lubricant scraped by the scraper 28U is stored in the depressions of the uneven portion 28*c* to suppress leakage of the lubricant at least onto the center portion of the fixing belt 21 in the width direction of the fixing belt 21 through which the recording medium P passes.

Figure 11:
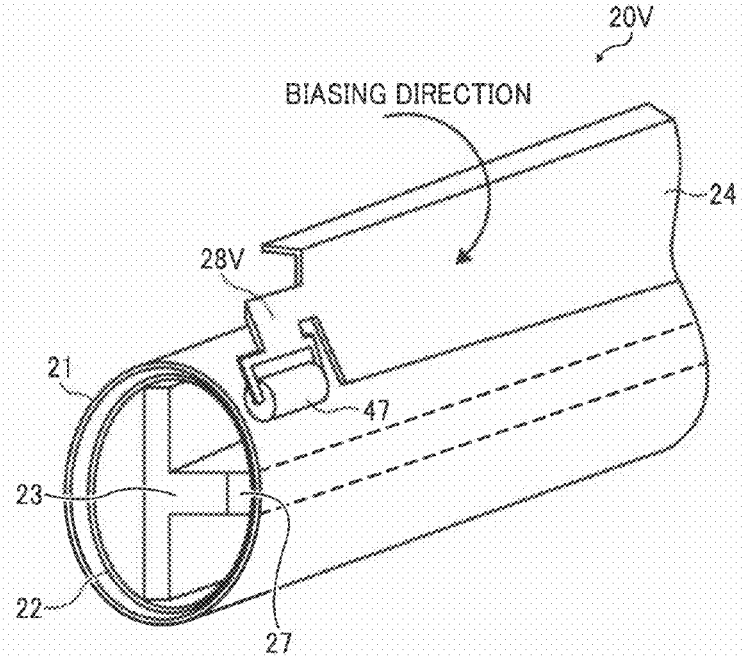
FIG. 11 is a perspective view of a fixing device illustrating yet another variation of the scraper shown in FIG. 5.

FIG. 11 is a perspective view of a fixing device 20V including scrapers 28V as yet another variation of the scrapers 28 depicted in FIG. 3. As illustrated in FIG. 11, the fixing device 20V includes the scrapers 28V. The scraper 28V includes a roller 47. The scraper 28V replaces the scraper 28S depicted in FIG. 8. The other elements of the fixing device 20V are equivalent to the elements of the fixing device 20S depicted in FIG. 8.

The roller 47 of the scraper 28V serving as a contact member that pressingly contacts the rotating fixing belt 21 is driven by the rotating fixing belt 21 to rotate in accordance with rotation of the fixing belt 21. An absorption member (e.g., felt or cloth impregnated with amine) for absorbing the lubricant may cover a surface of the roller 47 to absorb the lubricant leaked onto the fixing belt 21 while the roller 47 rotates in accordance with rotation of the fixing belt 21.

A contact portion of the scraper (e.g., the scraper 28, 28S, 28T, 28U, or 28V) which contacts the rotating fixing belt 21 may include a soft material having a surface hardness smaller than a surface hardness of the fixing belt 21. Accordingly, the contact portion of the scraper may wear more easily compared to the fixing belt 21. Consequently, the user can perform maintenance of the fixing device 20, 20S, or 20V easily at reduced costs by replacing the scraper, not the fixing belt 21, with a new one.

Figure 12:
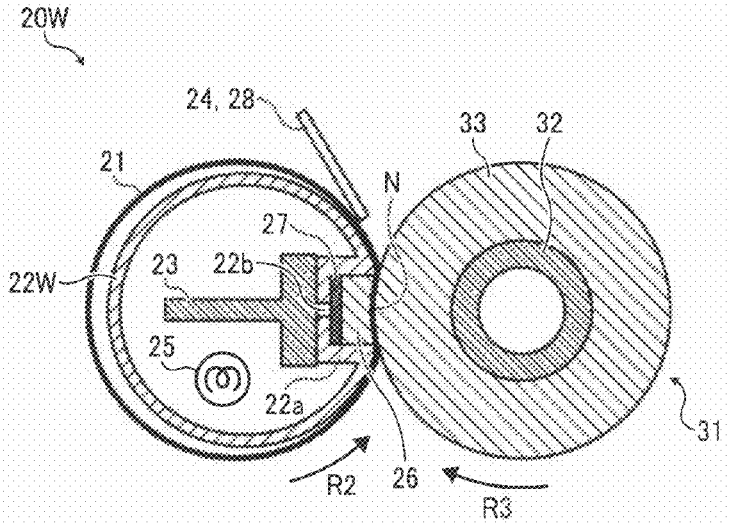
FIG. 12 is a sectional view of a fixing device according to another exemplary embodiment of the present invention.

FIG. 12 is a sectional view of a fixing device 20W according to another exemplary embodiment. As illustrated in FIG. 12, the fixing device 20W includes a holding member 22W and a stationary member 26. The holding member 22W includes a concave portion 22*a*. The concave portion 22*a* includes an opening 22*b*. The holding member 22W replaces the holding member 22 depicted in FIG. 3. The other elements of the fixing device 20W are equivalent to the elements of the fixing device 20 depicted in FIG. 3.

The holding member 22W includes the concave portion 22*a* facing the nip N. The stationary member 26 is provided in the concave portion 22*a* of the holding member 22W and is sandwiched between the holding member 22W and the fixing belt 21. The stationary member 26 serves as a nip formation member that presses against the pressing roller 31 via the fixing belt 21 to form the nip N between the fixing belt 21 and the pressing roller 31. The scrapers 28 slidably and pressingly contact the rotating fixing belt 21. Alternatively, the scrapers 28S, 28T, 28U, or 28V depicted in FIG. 8, 9, 10, or 11, respectively, may slidably and pressingly contact the rotating fixing belt 21 to provide effects equivalent to the above-described effects provided by the scrapers 28S, 28T, 28U, or 28V.

Figure 13:
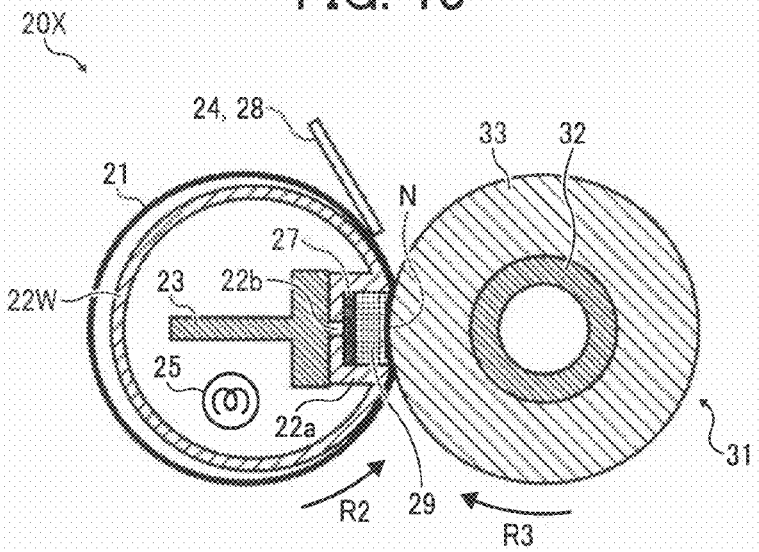
FIG. 13 is a sectional view of a fixing device according to yet another exemplary embodiment of the present invention.

FIG. 13 is a sectional view of a fixing device 20X according to yet another exemplary embodiment. As illustrated in FIG. 13, the fixing device 20X includes a lubricant holder 29 replacing the stationary member 26 depicted in FIG. 12. The other elements of the fixing device 20X are equivalent to the elements of the fixing device 20W depicted in FIG. 12.

The porous lubricant holder 29 is provided in the concave portion 22*a* of the holding member 22W and is sandwiched between the holding member 22W and the fixing belt 21. The lubricant holder 29 serves as a nip formation member that presses against the pressing roller 31 via the fixing belt 21 to form the nip N between the fixing belt 21 and the pressing roller 31. The lubricant holder 29 is impregnated with the lubricant. The scrapers 28 slidably and pressingly contact the rotating fixing belt 21. Alternatively, the scrapers 28S, 28T, 28U, or 28V depicted in FIG. 8, 9, 10, or 11, respectively, may slidably and pressingly contact the rotating fixing belt 21 to provide effects equivalent to the above-described effects provided by the scrapers 28S, 28T, 28U, or 28V.

Figure 14:
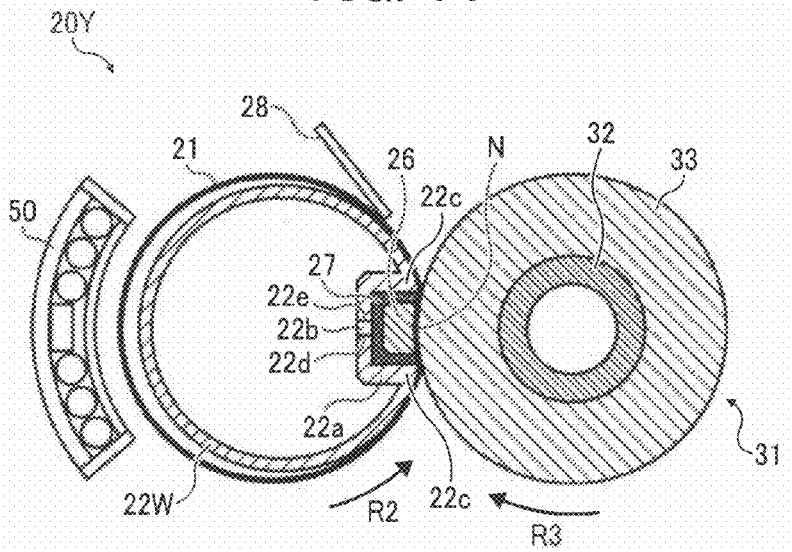
FIG. 14 is a sectional view of a fixing device according to yet another exemplary embodiment of the present invention.

FIG. 14 is a sectional view of a fixing device 20Y according to yet another exemplary embodiment. As illustrated in FIG. 14, the fixing device 20Y includes an induction heater 50. The holding member 22W further includes corner portions 22*c*, an upstream edge 22*d*, and a downstream edge 22*e*. The induction heater 50 replaces the heater 25 depicted in FIG. 12. The other elements of the fixing device 20Y are equivalent to the elements of the fixing device 20W depicted in FIG. 12.

The fixing device 20Y includes the induction heater 50 instead of the heater 25 (e.g., a halogen heater or a carbon heater) depicted in FIG. 12. The induction heater 50 is provided outside the loop formed by the fixing belt 21 to face the outer circumferential surface of the fixing belt 21, and serves as a heater for heating the fixing belt 21 by using electromagnetic induction of induction heating (IH).

The induction heater 50 includes an exciting coil, a core, and a coil guide. The exciting coil includes litz wires formed of bundled thin wires and extended in the width direction of the fixing belt 21 to cover a part of the fixing belt 21. The coil guide includes heat-resistant resin and holds the exciting coil and the core. The core is a semi-cylindrical member formed of a ferromagnet (e.g., ferrite) having relative magnetic permeability in a range of from about 1,000 to about 3,000. The core includes a center core and a side core to generate magnetic fluxes toward the holding member 22W effectively. The core is disposed opposite the exciting coil extending in the width direction of the fixing belt 21.

The following describes operation of the fixing device 20Y including the induction heater 50 having the above-described structure.

When the fixing belt 21 rotates in the rotation direction R2, the induction heater 50 heats the fixing belt 21 at a position at which the fixing belt 21 faces the induction heater 50. Specifically, a high-frequency alternating current is applied to the exciting coil to generate magnetic lines of force around the holding member 22W in such a manner that the magnetic lines of force are alternately switched back and forth. Accordingly, an eddy current generates on a surface of the holding member 22W, and electric resistance of the holding member 22W generates Joule heat. The Joule heat heats the holding member 22W by electromagnetic induction, and the heated holding member 22W heats the fixing belt 21.

In order to heat the holding member 22W effectively by electromagnetic induction, the induction heater 50 may face the holding member 22W in an entire circumferential direction of the holding member 22W. The holding member 22W may include nickel, stainless steel, iron, copper, cobalt, chrome, aluminum, gold, platinum, silver, tin, palladium, an alloy of a plurality of those metals, and/or the like.

The holding member 22W contacts or faces the inner circumferential surface of the fixing belt 21 to support or hold the fixing belt 21 to heat the fixing belt 21. The holding member 22W may be manufactured by bending a thin metal plate into a pipe shape at relatively reduced manufacturing costs, improving heating efficiency for heating the fixing belt 21, shortening a warm-up time or a first print time, and suppressing faulty fixing which may occur when the fixing device 20Y is driven at high speed.

Figure 15:
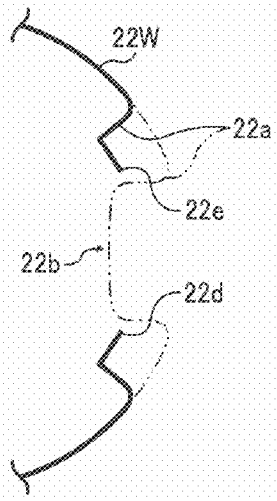
FIG. 15 is a partially enlarged view of a holding member included in the fixing device shown in FIG. 14.

FIG. 15 is a partially enlarged view of the holding member 22W. If the thin metal plate is bent into the pipe shape in such a manner that the upstream edge 22*d* of the holding member 22W provided upstream from the nip N in the rotation direction R2 of the fixing belt 21 (depicted in FIG. 14) is separated from the downstream edge 22*e* of the holding member 22W provided downstream from the nip N, the inherent spring-back of the thin metal plate may enlarge the opening 22*b* between the upstream edge 22*d* and the downstream edge 22*e* as illustrated in FIG. 15. Accordingly, the holding member 22W may not contact or press against the fixing belt 21 with uniform pressure.

To address this problem, at least a part of the upstream edge 22*d* in a width direction, that is, an axial direction, of the holding member 22W may be combined with the downstream edge 22*e* to prevent the spring-back of the holding member 22W from enlarging the opening 22*b* between the upstream edge 22*d* and the downstream edge 22*e*. For example, the upstream edge 22*d* may be combined with the downstream edge 22*e* by welding.

In the holding member 22W illustrated in FIGS. 12 to 14, the corner portions 22*c* (depicted in FIG. 14) are provided in the concave portion 22*a*. If the corner portions 22*c* and the vicinity thereof press against the pressing roller 31 via the fixing belt 21, pressure applied by the pressing roller 31 may deform the holding member 22W. Accordingly, the holding member 22W may not contact or press against the fixing belt 21 with uniform pressure.

To address this problem, according to the above-described exemplary embodiments, the holding member 22W including the corner portions 22*c* does not press against the pressing roller 31 via the fixing belt 21. For example, the corner portions 22*c* are provided at positions separated from the nip N so that the corner portions 22*c* are separated from the pressing roller 31.

Figure 16:
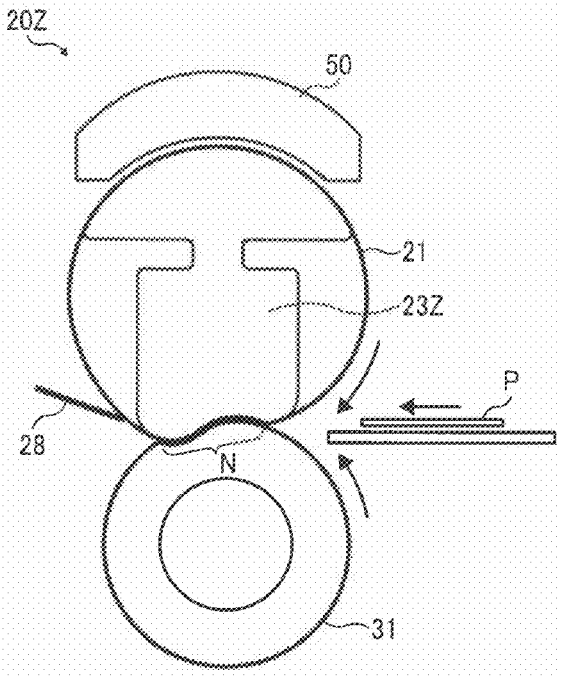
FIG. 16 is a sectional view of a fixing device according to yet another exemplary embodiment of the present invention.

In the fixing device 20Y depicted in FIG. 14, the induction heater 50 is provided outside the loop formed by the fixing belt 21, and heats the fixing belt 21 via the holding member 22W. Alternatively, the induction heater 50 may heat the fixing belt 21 directly. FIG. 16 is a sectional view of a fixing device 20Z including the induction heater 50 heating the fixing belt 21 directly. As illustrated in FIG. 16, the fixing device 20Z includes the fixing belt 21, a reinforcement member 23Z, the scrapers 28, the pressing roller 31, and the induction heater 50.

In the fixing device 20Z, the reinforcement member 23Z is provided inside the loop formed by the fixing belt 21, and serves as a nip formation member that presses against the pressing roller 31 via the fixing belt 21 to form the nip N between the fixing belt 21 and the pressing roller 31 and as a holding member that holds the fixing belt 21 in such a manner that the fixing belt 21 has a circular shape.

The fixing belt 21 includes a conductive layer as an inner layer. When magnetic lines of force generated by the induction heater 50 pass over the conductive layer of the fixing belt 21, an eddy current is generated in the conductive layer that generates a magnetic field that prevents change of an alternating magnetic field of the magnetic lines of force. The eddy current flowing in the conductive layer generates Joule heat proportional to the resistance of the conductive layer to heat the fixing belt 21.

In the fixing devices 20Y and 20Z depicted in FIGS. 14 and 16, respectively, the scrapers 28 slidably and pressingly contact the rotating fixing belt 21 to provide effects equivalent to the above-described effects provided by the scrapers 28S, 28T, 28U, or 28V depicted in FIG. 8, 9, 10, or 11, respectively.

According to the above-described exemplary embodiments, in the fixing devices 20, 20S, 20V, 20W, 20X, 20Y, and 20Z, the pressing roller 31 is used as a pressing member. Alternatively, a pressing belt or a pressing pad may be used as a pressing member to provide effects equivalent to the above-described effects provided by the fixing device 20, 20S, 20V, 20W, 20X, 20Y, or 20Z including the pressing roller 31.

According to the above-described exemplary embodiments, the fixing belt 21 having a multi-layered structure is used as a fixing member. Alternatively, an endless fixing film including polyimide resin, polyamide resin, fluorocarbon resin, and/or thin metal may be used as a fixing member to provide effects equivalent to the above-described effects provided by the fixing device 20, 20S, 20V, 20W, 20X, 20Y, or 20Z including the fixing belt 21.

As described above, in a fixing device (e.g., the fixing device 20, 20S, 20V, 20W, 20X, 20Y, or 20Z depicted in FIG. 3, 8, 11, 12, 13, 14, or 16, respectively), a heater (e.g., the heater 25 depicted in FIG. 3, 12, or 13 or the induction heater 50 depicted in FIG. 14 or 16) heats a flexible fixing member (e.g., the fixing belt 21 depicted in FIG. 3, 8, 11, 12, 13, 14, or 16). A nip formation member (e.g., the reinforcement member 23 depicted in FIG. 3, 8, 11, or 12, the lubricant holder 29 depicted in FIG. 13, the stationary member 26 depicted in FIG. 14, or the reinforcement member 23Z depicted in FIG. 16) is disposed opposite a pressing member (e.g., the pressing roller 31 depicted in FIG. 3, 12, 13, 14, or 16) via the fixing member to form a nip between the fixing member and the pressing member. Rotation of the pressing member rotates the fixing member to convey a recording medium bearing a toner image through the nip. A contact member (e.g., the scrapers 28, 28S, 28T, 28U, or 28V depicted in FIG. 3, 8, 9, 10, or 11) slidably and pressingly contacts both ends of the fixing member in an axial direction of the fixing member to stabilize movement of the fixing member and suppress deformation of the fixing member at a position near an exit of the nip from which the recording medium is discharged from the nip.

The contact member prevents leakage of a lubricant applied between a holding member (e.g., the holding member 22 depicted in FIG. 3, 8, or 11, the holding member 22W depicted in FIG. 12, 13, or 14, or the reinforcement member 23Z depicted in FIG. 16) and the fixing member sliding over the holding member.

Accordingly, the contact member prevents leakage of the lubricant from both ends of the fixing member in the axial direction of the fixing member. Moreover, even when the lubricant leaks from both ends of the fixing member, the contact member scrapes the lubricant from the fixing member.

The contact member may be provided on a support (e.g., the flanges 46 depicted in FIG. 5) for supporting the fixing member. In other words, the contact member is provided on the durable support that supports the fixing member. Accordingly, the contact member slides over the fixing member precisely.

The contact member may be provided on a separator (e.g., the separation plate 24 depicted in FIG. 8 or 11) that separates the recording medium from the fixing member. Accordingly, the contact member is installed in the fixing device easily without occupying a substantial space.

The contact member may include a concave portion (e.g., the concave portion 28*b* depicted in FIG. 9) on a non-contact surface disposed opposite a contact surface of the contact member which contacts the rotating fixing member. Accordingly, the concave portion receives and stores the lubricant scraped by the contact member to suppress scattering and returning of the lubricant onto the fixing member.

The contact member may include a contact portion that contacts the rotating fixing member and includes a soft material having a hardness smaller than a surface hardness of the fixing member. Accordingly, the contact member, which can be replaced with a new one easily, may wear faster than the fixing member to facilitate easy maintenance of the fixing device.

The contact member may be plate-shaped to facilitate manufacturing of the contact member.

The contact member may include a roller (e.g., the roller 47 depicted in FIG. 11) to reduce load applied to the contact member due to sliding.

The fixing member may include a flexible endless belt to simplify the fixing device.

The heater may be provided outside the fixing member to simplify the structure inside the fixing member and the structure for locating the heater.

The heater may heat an outer circumferential surface of the fixing member directly to improve heating efficiency for heating the fixing member.

The holding member may contact an inner circumferential surface of the flexible endless belt of the fixing member to stabilize movement of the belt and maintain the shape of the belt, thus improving fixing property of the fixing member.

The heater may be provided inside the holding member, and may heat the belt via the holding member. In other words, the heater is provided inside the holding member and the belt to improve heating efficiency for heating the holding member and the belt.

An image forming apparatus (e.g., the image forming apparatus 1 depicted in FIG. 2) includes an image forming device (e.g., the image forming devices 4Y, 4M, 4C, and 4K depicted in FIG. 2) that forms the toner image on the recording medium and the fixing device that fixes the toner image on the recording medium. Accordingly, the image forming apparatus forms the high-quality toner image on the recording medium stably with improved fixing performed by the fixing device.

In the fixing device, the contact member slidably and pressingly contacts both ends of the fixing member in the axial direction of the fixing member to stabilize movement of the fixing member and suppress deformation of the fixing member at the position near the exit of the nip formed between the fixing member and the pressing member from which the recording medium bearing the toner image is discharged. In other words, stable movement of the fixing member suppresses deformation of both ends of the fixing member in the axial direction of the fixing member. Further, when a lubricant is applied to a gap between the fixing member and the holding member, the contact member prevents leakage of the lubricant from the gap between the fixing member and the holding member at both ends of the fixing member onto the outer circumferential surface of the fixing member. Moreover, even when the lubricant leaks from the gap, the contact member scrapes the lubricant from the outer circumferential surface of the fixing member. Thus, the fixing device fixes the toner image on the recording medium stably without staining the recording medium or faulty conveyance. In other words, the fixing device provides reliable high-quality fixing.

The present invention has been described above with reference to specific exemplary embodiments. Note that the present invention is not limited to the details of the embodiments described above, but various modifications and enhancements are possible without departing from the spirit and scope of the invention. It is therefore to be understood that the present invention may be practiced otherwise than as specifically described herein. For example, elements and/or features of different illustrative exemplary embodiments may be combined with each other and/or substituted for each other within the scope of the present invention.

What is claimed is:

1. A fixing device comprising:

a pressing member to rotate in a predetermined direction of rotation;

a flexible fixing member disposed opposite the pressing member to rotate in accordance with rotation of the pressing member;

a nip formation member provided inside a loop formed by the fixing member and pressed against the pressing member via the fixing member to form a nip between the fixing member and the pressing member through which a recording medium bearing a toner image passes; and a contact member to pressingly contact an outer circumferential surface of the rotating fixing member at both ends of the fixing member in an axial direction thereof, wherein the contact member slides over the outer circumferential surface of the rotating fixing member at a position near an exit of the nip from which the recording medium is discharged from the nip, and wherein the contact member suppresses deformation of the fixing member at the position near the exit of the nip.

2. The fixing device according to claim 1, further comprising a holding member provided inside the loop formed by the fixing member to hold the fixing member, the holding member including a sliding surface over which the fixing member slides and being applied with a lubricant, wherein the contact member presses the fixing member against the holding member to prevent leakage of the lubricant onto the outer circumferential surface of the fixing member.

3. The fixing device according to claim 2, wherein the fixing member comprises a flexible endless belt and the holding member contacts an inner circumferential surface of the belt.

4. The fixing device according to claim 3, further comprising a heater provided inside the holding member to heat the belt via the holding member.

5. The fixing device according to claim 1, further comprising a support to contact and support the fixing member, wherein the contact member is provided on the support.

6. The fixing device according to claim 5, wherein the support comprises at least one side plate, perpendicular to an axis of revolution of the pressing member.

7. The fixing device according to claim 1, further comprising a separator disposed close to the outer circumferential surface of the fixing member to separate the recording medium from the fixing member, wherein the contact member is provided on the separator.

8. The fixing device according to claim 1, wherein the contact member comprises a concave portion provided on a non-contact surface of the contact member disposed opposite a contact surface of the contact member contacting the rotating fixing member.

9. The fixing device according to claim 1, wherein the contact member is plate-shaped.

10. The fixing device according to claim 1, wherein the contact member comprises a roller to contact the outer circumferential surface of the rotating fixing member.

11. The fixing device according to claim 1, wherein the fixing member comprises a flexible endless belt.

12. The fixing device according to claim 1, further comprising a heater provided outside the loop formed by the fixing member to heat the fixing member.

13. The fixing device according to claim 12, wherein the heater heats the outer circumferential surface of the fixing member directly.

14. A fixing device comprising:

a pressing member to rotate in a predetermined direction of rotation;

a flexible fixing member disposed opposite the pressing member to rotate in accordance with rotation of the pressing member;

a nip formation member provided inside a loop formed by the fixing member and pressed against the pressing member via the fixing member to form a nip between the fixing member and the pressing member through which a recording medium bearing a toner image passes; and a contact member to pressingly contact an outer circumferential surface of the rotating fixing member at both ends of the fixing member in an axial direction thereof, wherein the contact member slides over the outer circumferential surface of the rotating fixing member at a position near an exit of the nip from which the recording medium is discharged from the nip, and wherein the contact member comprises a contact portion contacting the rotating fixing member and including a material having a hardness smaller than a hardness of the outer circumferential surface of the fixing member.

15. An image forming apparatus comprising:

an image forming device to form a toner image on a recording medium; and a fixing device to fix the toner image on the recording medium, the fixing device comprising:

a pressing member to rotate in a predetermined direction of rotation;

a flexible fixing member disposed opposite the pressing member to rotate in accordance with rotation of the pressing member;

a nip formation member provided inside a loop formed by the fixing member and pressed against the pressing member via the fixing member to form a nip between the fixing member and the pressing member through which the recording medium bearing the toner image passes; and a contact member to pressingly contact an outer circumferential surface of the rotating fixing member at both ends of the fixing member in an axial direction thereof, wherein the contact member slides over the outer circumferential surface of the rotating fixing member at a position near an exit of the nip from which the recording medium is discharged from the nip, and wherein the contact member suppresses deformation of the fixing member at the position near the exit of the nip.

16. A fixing device comprising:

first rotating means for rotating in a predetermined direction of rotation;

second rotating means for rotating in accordance with rotation of the first rotating means;

nip forming means for forming a nip, through which a recording medium bearing a toner image passes, between the first rotating means and the second rotating means by pressing the second rotating means against the first rotating means; and contact means for pressingly contacting an outer circumferential surface of the second rotating means at both ends of the second rotating means in an axial direction thereof, wherein the contact means slide over the outer circumferential surface of the second rotating means at a position near an exit of the nip from which the recording medium is discharged from the nip, and wherein the contact means suppress deformation of the second rotating means at the position near the exit of the nip.

* * * * *